US006504119B1

(12) United States Patent
Ribeiro

(10) Patent No.: US 6,504,119 B1
(45) Date of Patent: Jan. 7, 2003

(54) INFRARED ON/OFF BUTTON FOR COMPUTING APPARATUS

(75) Inventor: Durval S. Ribeiro, Owatonna, MN (US)

(73) Assignee: SPX Corporation, Charlotte, NC (US)

( * ) Notice: Subject to any disclaimer, the term of this patent is extended or adjusted under 35 U.S.C. 154(b) by 15 days.

(21) Appl. No.: 09/702,803

(22) Filed: Nov. 1, 2000

Related U.S. Application Data

(60) Provisional application No. 60/240,820, filed on Oct. 17, 2000.

(51) Int. Cl.[7] ..... H01H 9/18; H01H 13/14

(52) U.S. Cl. ..... 200/314; 200/341

(58) Field of Search ..... 200/308–314, 200/330–334, 341–345; 379/433

(56) References Cited

U.S. PATENT DOCUMENTS 4,419,555 A * 12/1983 Kim ..... 200/293
4,778,967 A * 10/1988 Deng ..... 200/292
5,201,408 A * 4/1993 Torma et al. ..... 200/292
5,252,798 A * 10/1993 Kamada ..... 200/310
5,336,860 A * 8/1994 Slocum ..... 200/332.1
5,428,388 A 6/1995 von Bauer et al. ..... 348/155
5,459,489 A 10/1995 Redford ..... 345/179
5,655,826 A * 8/1997 Kouno et al. ..... 200/314
5,788,060 A * 8/1998 Kuroda ..... 200/343
5,844,203 A * 12/1998 Chasen et al. ..... 200/314

* cited by examiner

*Primary Examiner*—Michael Friedhofer
(74) *Attorney, Agent, or Firm*—Baker & Hostetler, LLP

(57) ABSTRACT

A push button assembly for a portable electronic apparatus includes an upper surface having a translucent portion, a stem positioned substantially perpendicular to the upper surface, and an actuating switch. The switch is located within the interior of the electronic apparatus and is positioned to be actuated by the stem when the upper surface is pressed by a user. A spring maintains the upper surface in a relaxed position when the spring is undepressed. At least one light source is positioned within the electronic apparatus such that emissions from the light source extend through the translucent portion of the upper surface when the light source is actuated. The push button assembly may also include at least three ribs positioned along the stem. Each rib has a locking rib sized and positioned to engage at least one link of the spring so that the spring may remain attached to the stem during assembly of the electronic apparatus.

14 Claims, 3 Drawing Sheets

INFRARED ON/OFF BUTTON FOR COMPUTING APPARATUS

PRIORITY

This application claims priority to the provisional patent application No. 60/240,820 entitled, "Infrared On/Off Button," filed Oct. 17, 2000.

FIELD OF THE INVENTION

The present invention relates generally to pushbutton actuators for portable electronic devices. More particularly, the present invention relates to an on-off button for a portable electronic apparatus having an infrared transmitter and/or receiver, and having a spring retainer to facilitate installation of the button onto the apparatus during assembly.

BACKGROUND OF THE INVENTION

Portable electronic computing devices, such as diagnostic equipment or analyzers, electronic games, remote controls, pocket computers and palms, and other devices have been developed with many configurations for many applications, including industrial applications, commercial applications, business applications, and entertainment applications. As power of the processors and the capacity of the memory used in these devices has increased, users have demanded that the devices provide additional functionality. For example, a diagnostic device such as an engine analyzer may serve to collect and analyze multiple aspects of an engine or vehicle, including aspects of vehicle operation such as emissions components, system pressure, fluid pressure, system temperature, and other aspects or conditions.

To provide such additional functionality in portable computing devices, manufacturers seek ways in which the physical components of the device, such as switches, displays, inputs, etc. can be made smaller so that multiple components may be included in a relatively small device. However, if the components are made too small, it may be difficult for a user to use the components, as components such as buttons must be sized to accept an ordinary human finger without inadvertent actuation. In addition, if too many components are added to a device, the device can become unwieldy, and a user may have difficulty learning the functions of the various components.

An example of such a prior electronic device may be found in U.S. Pat. No. 5,459,489, to Redford, which discloses a hand held electronic remote control device having orientation sensors, signal processing electronics, a power supply, and an infrared transmitter. The device disclosed in Redford also includes a plurality of input controls such as right and left mouse buttons, a cursor activation button and other control keys.

Another example of such a prior electronic device may be found in U.S. Pat. No. 5,248,388, to von Bauer et al., which discloses a hand-held communicator that includes an infrared transceiver having an infrared emitting diode and an infrared-sensitive photodetector. The communicator also includes an eleven-button keyboard, a loudspeaker, and a microphone.

The prior art portable electronic devices such as those disclosed in Redford and von Bauer provide limited functionality in part because of the limited space available on the devices to add functionality components. For example, if a button were available that could combine multiple features, such as signal emitting, signal receiving, and unit actuation, room would be available for additional components having other functions. Also, the device would appear less crowded to the user and would thus be easier for the user to learn.

Further, as components such as buttons are made smaller and included in smaller electronic devices, manufacturers seek ways to speed and prevent errors in the manufacturing process. Buttons such as on-off buttons may serve to engage switches located within the device, and the buttons may be equipped with one or more springs to keep the button in a disengaged position when the button is not depressed. In portable electronic devices, such springs are typically very small, and they require a very detailed and time consuming assembly procedure to ensure that the springs do not fall off during the assembly process. An example of such a spring-equipped button is disclosed in U.S. Pat. No. 5,957,270, to Ahn.

Accordingly, a button component for a portable computing apparatus that includes the features of providing on/off actuation and infrared signal transmission and/or receipt in a compact component is needed.

A button component for a portable computing apparatus that is capable of holding a spring in place when the component is assembled onto the apparatus is also needed.

SUMMARY OF THE INVENTION

It is therefore a feature and advantage of the present invention to provide a button component for a portable computing apparatus that provides on/off actuation and infrared signal transmission and/or receipt.

It is another feature and advantage of the present invention to provide a button component for a portable computing apparatus that is capable of holding a spring in place when the component is assembled onto the apparatus.

The above and other features and advantages are achieved through the use of a novel infrared on/off button as herein disclosed. In accordance with one embodiment of the present invention, a push button assembly comprises an upper surface positioned substantially along an exterior of a portable electronic apparatus. The electronic apparatus also has an interior. The upper surface includes a translucent portion and is displaceable by an ordinary human finger. A stem having a first end and a second end is positioned substantially perpendicular to the upper surface and extends into the interior of the electronic apparatus. The first end of the stem is adjacent to the upper surface. An actuating switch is located within the interior of the electronic apparatus and is positioned to be separated a distance from the stem when the upper surface is in an undepressed position. The switch is also positioned such that the stem contacts the actuating switch when the upper surface is depressed. At least one light source is positioned within the interior of the electronic apparatus such that emissions from the light source extend through the translucent portion of the upper surface when the light source is actuated. Optionally, the push button assembly also comprises at least one light sensor positioned within the interior of the electronic apparatus such that the sensor detects light received through the translucent portion of the upper surface. Optionally, the translucent portion of the push button assembly comprises the entire upper surface. A further option is that the push button assembly also has a spring having an interior axis and an interior diameter positioned such that the stem is located along the interior axis of the spring. The spring is disposed to maintain a separation between the actuating switch and the stem when the upper surface is in an undepressed position. In such an embodiment, at least three ribs are positioned along the stem to establish a stem diameter that is greater than the interior diameter of the spring when the spring is in a relaxed position. Each rib also contains a groove sized and positioned to engage at least one link of the spring such that the spring remains attached to the stem during assembly of the electronic apparatus.

In accordance with another embodiment of the present invention, a push button assembly comprises an upper surface positioned to form a portion of the exterior of a portable electronic apparatus. The electronic apparatus also includes an interior. A stem having a first and second end is positioned substantially perpendicular to the upper surface and extends into the interior of the electronic apparatus. The first end of the stem is adjacent to the upper surface. An actuating switch is separated a distance from the stem when the upper surface is in an undepressed position and positioned such that the stem contacts the actuating switch when the upper surface is depressed. At least one light source is positioned within the interior of the electronic apparatus such that emissions from the light source extend through the translucent portion of the upper surface when the light source is actuated.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract set forth below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

A preferred embodiment of the present invention provides a novel on/off button for a portable electronic apparatus that includes the features of an infrared transmitter and/or receiver. The invention reduces assembly costs and streamlines the apparatus by including such features in one unit. In addition, a preferred embodiment of the present invention includes a feature that facilitates attachment of the spring to the on/off button so that assembly is made easier and more cost effective by preventing the spring from falling off during the assembly process.

Figure 1:
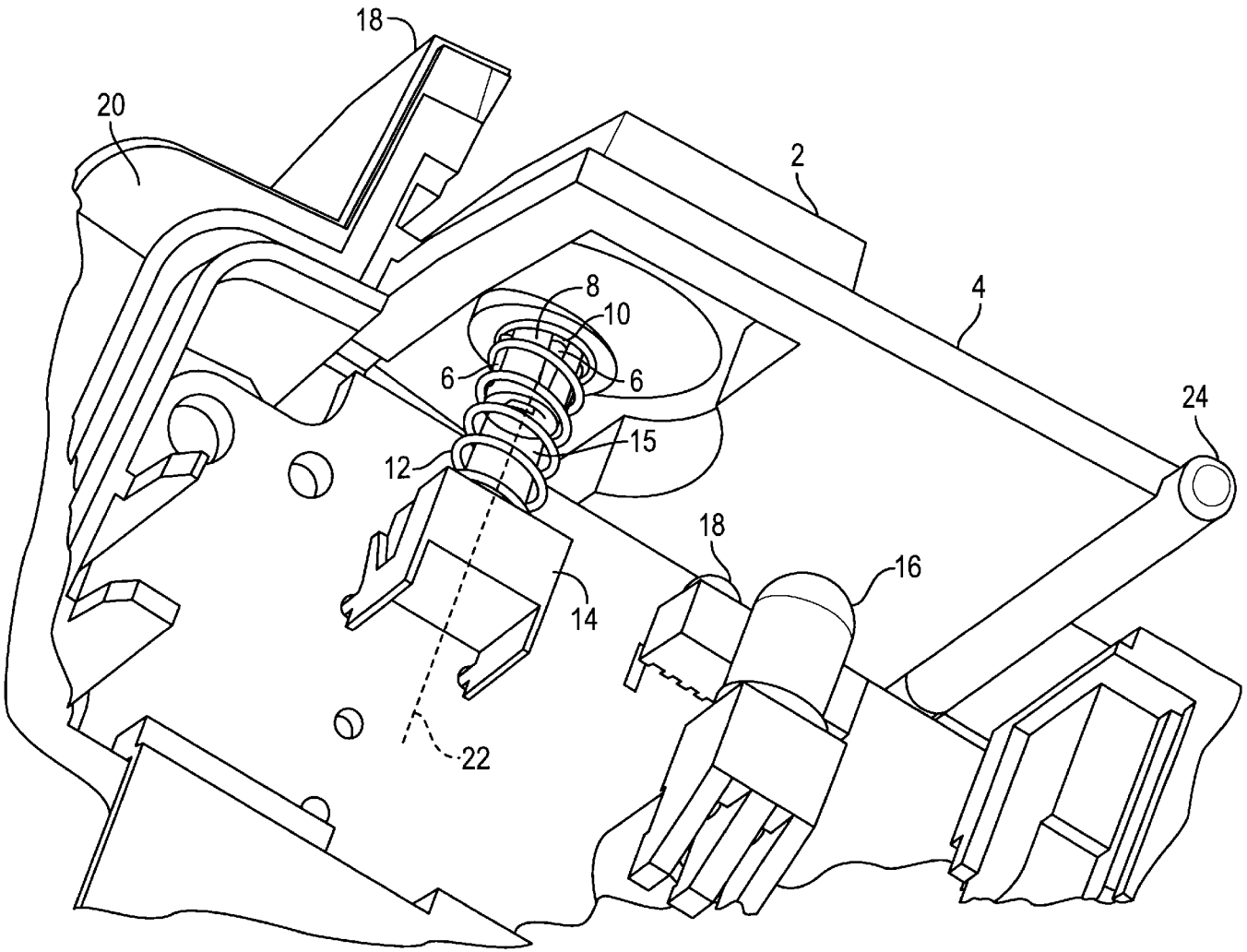
FIG. 1 is a perspective view of the features of various element of a preferred embodiment of present invention.

An exemplary embodiment of the present inventive assembly is illustrated in FIG. 1. Referring to FIG. 1, an upper surface 4 of a button is positioned to form part of the exterior 18 of an electronic apparatus 20 so that a user of the apparatus may depress the button. The upper surface 4 optionally includes a support portion 2 to provide additional support and/or a grip at the point where the user is likely to depress the button. The assembly also includes a post or stem 8 that is adjoined to the upper surface 4 or the support portion 2 and extends into the interior of the electronic apparatus 20 so that when the translucent panel 4 or support portion 2 is depressed by a user, the stem 8 engages a switch 14. The switch 14 causes the apparatus to perform a function, such as powering up or down. The switch 14 may optionally include a post 15 sized and positioned to receive the stem 8.

A spring 12 is positioned between the upper surface 4 and a portion of the switch 14 such as the base or housing of the switch such that the upper surface 4 is maintained in a rest position when the button is not depressed. The spring 12 includes an interior axis 22, and the stem 8 is positioned along the interior axis 22. At least three ribs 6 are affixed to the stem 8 and are sized so that the spring must be stretched around the ribs 6 in order to be placed onto the ribs 6. Each rib 6 includes a locking rib 10 sized and positioned to hold the spring 12 into place. The ribs 6 are positioned around the diameter of stem 8 in a symmetrical or near symmetrical format.

The assembly in this embodiment includes a light source 16, such as a light emitting diode ("LED"), or a laser light source. Optionally, the assembly may also include a light sensor 18. The portion of the upper surface 4 above the light source 16 and the light sensor 18 is made of a translucent material, so that light from the light source 16 may be received by the sensor 18 through the translucent portion of the upper surface 4.

Figure 2:
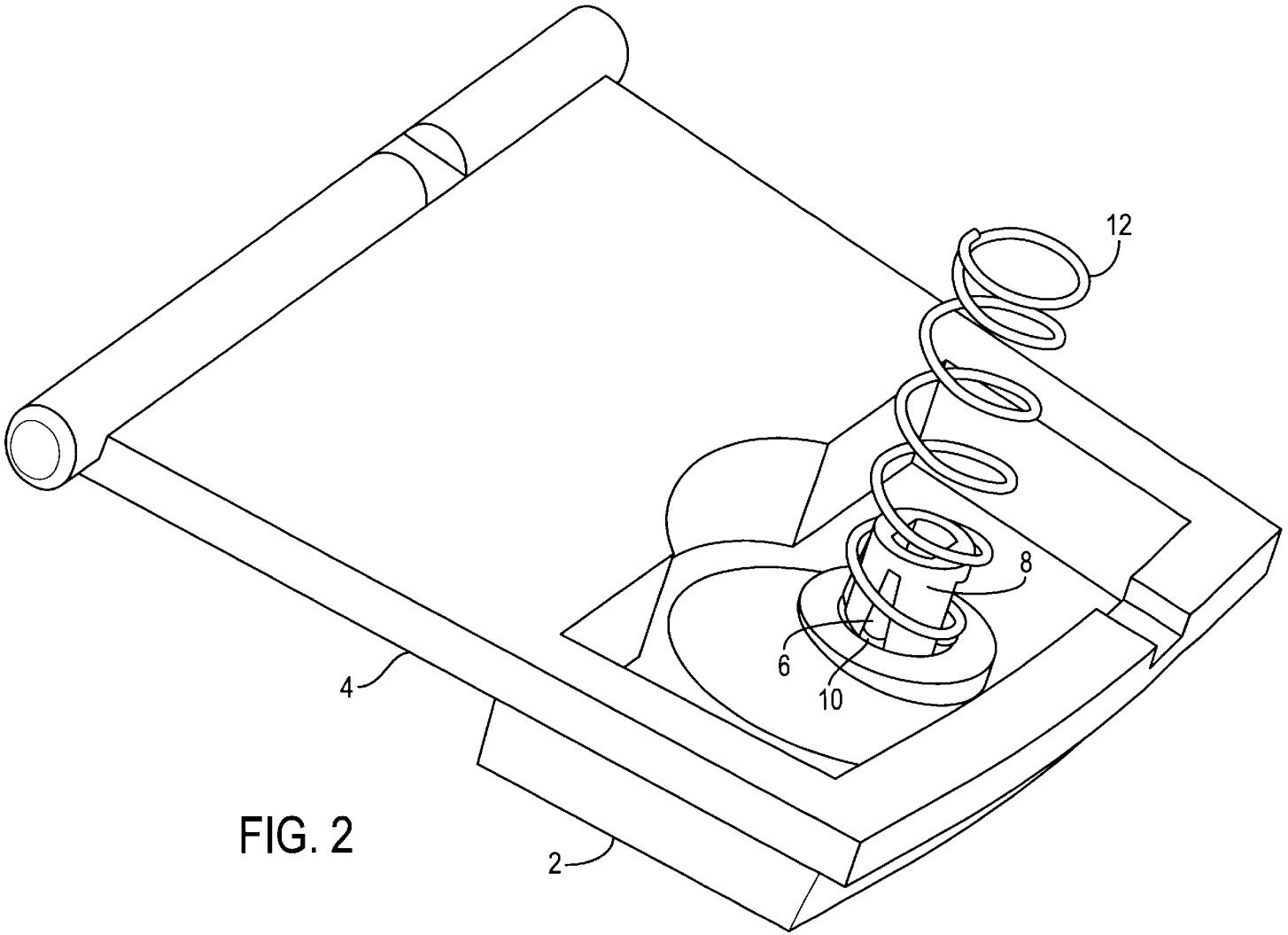
FIG. 2 provides another perspective view of several of the features illustrated in FIG. 1.
Figure 3:
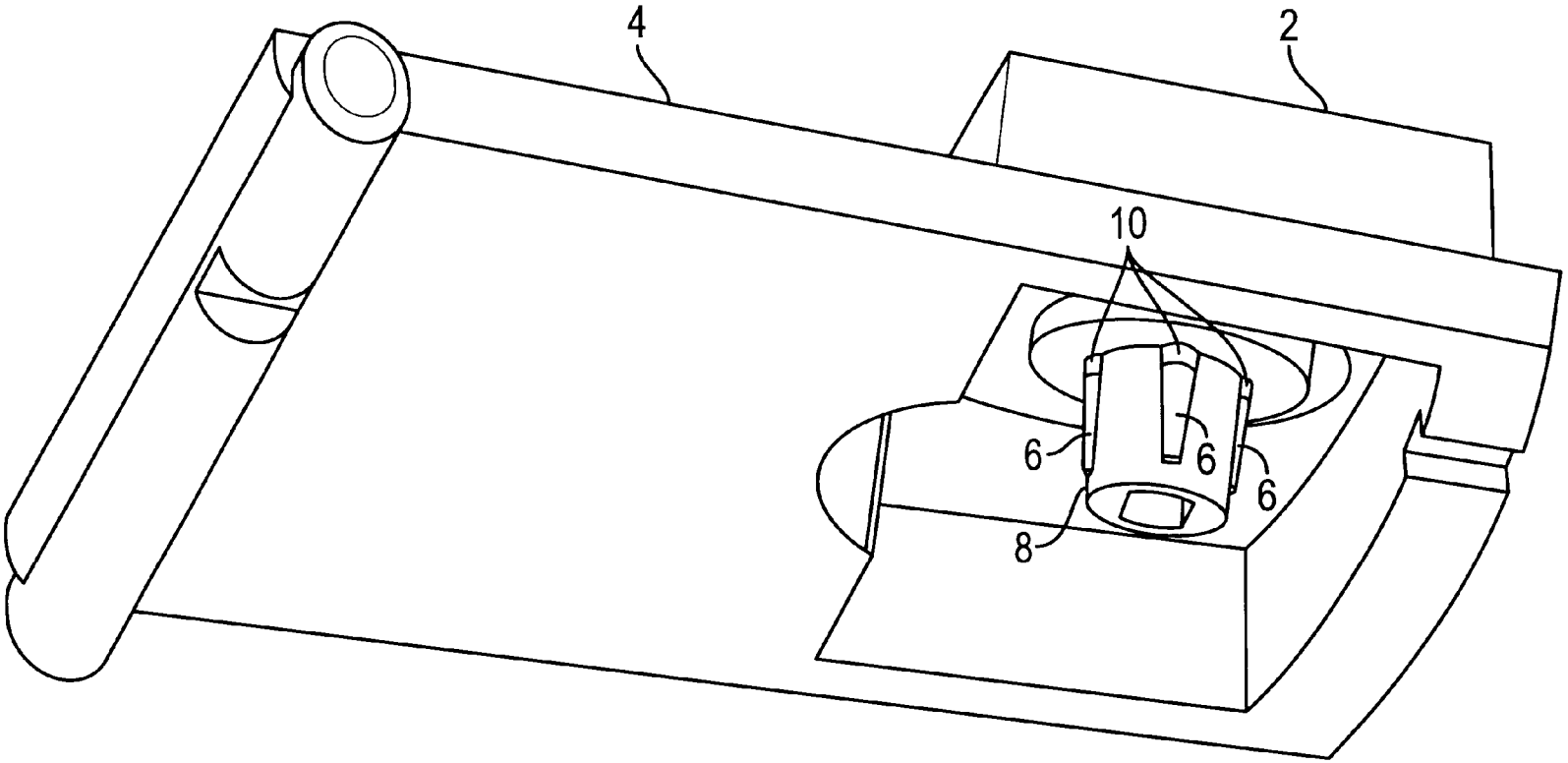
FIG. 3 provides another perspective view of several of the features illustrated in FIG. 1.

FIGS. 2 and 3 provide additional perspectives of various features of the present invention. FIG. 2 illustrates the features of the stem 8, ribs 6 having locking ribs 10, and spring 12, along with the upper surface 4 and optional supporting surface 2. Such features are also displayed in FIG. 3.

Referring again to FIG. 1, the electronic apparatus 20 may be an item of diagnostic equipment, such as a vehicle engine analyzer or emission tester, an electronic game, a remote control, a pocket computer, or any other portable electronic device. The housing 18 of the electronic apparatus 20 may be made of any appropriate material, such as plastic or an elastomer, or even a metal. The housing includes an opening sized and positioned to receive the upper surface 4 of the button. The upper surface 4 is attached to the electronic apparatus 20 by a hinge 24. The stem 8 of the push button assembly is made of a material having sufficient support to receive the force a human finger when the button is depressed in normal operation. Such material may include, for example, plastic, an elastomer, a metal such as an aluminum or steel, or any other hard or semihard material.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A push button assembly comprising:

(a) an upper surface positioned substantially along an exterior of a portable electronic apparatus, the electronic apparatus also having an interior, the upper surface displaceable by a finger, the upper surface having a translucent portion;

(b) a stem having a first end and a second end, the stem positioned substantially perpendicular to the upper surface, the stem extending into the interior of the electronic apparatus, the first end adjacent to the upper surface;

(c) an actuating switch positioned such that the stem actuates the actuating switch when the upper surface is depressed;

(d) at least one light source positioned within the interior of the electronic apparatus such that emissions from the light source are capable of extending through the translucent portion of the upper surface when the light source is actuated;

(e) a spring having an interior axis and an interior diameter, the spring being positioned such that the stem is located along the interior axis, and the spring being disposed to maintain a separation between the actuating switch and the stem when the upper surface is in an undepressed position; and (f) at least three ribs positioned along the stem to establish a stem diameter that is greater than the interior diameter of the spring when the spring is in a relaxed position, each rib also including a locking rib sized and positioned to engage at least one loop of the spring such that the spring may remain attached to the stem during assembly of the electronic apparatus.

2. The push button assembly of claim 1, further comprising at least one light sensor positioned within the interior of the electronic apparatus such that the at least one light sensor detects light received through the translucent portion of the upper surface.

3. The push button assembly of claim 1, wherein the translucent portion comprises the entire upper surface.

4. A push button assembly, comprising:

(a) an upper surface positioned to form a portion of an exterior of a portable electronic apparatus, the electronic apparatus also having an interior;

(b) a stem having a first end and a second end, the stem positioned substantially perpendicular to the upper surface, the stem extending into the interior of the electronic apparatus, the first end adjacent to the upper surface;

(c) an actuating switch positioned such that the stem actuates the actuating switch when the upper surface is depressed;

(d) a spring having an interior axis and an interior diameter, positioned such that the stem is located along the interior axis, and disposed to maintain the upper surface in a relaxed position when the upper surface is in an undepressed position; and (e) at least three ribs positioned along the stem to establish a stem diameter that is greater than the interior diameter of the spring when the spring is in a relaxed position, each of said at least three ribs also including a locking rib sized and positioned to engage to at least one loop of the spring such that the spring may remain attached to the stem during assembly of the electronic apparatus.

5. An electronic apparatus, comprising:

(a) a housing and an interior;

(b) a displaceable upper surface positioned substantially along the housing; the upper surface including a transitional portion;

(c) a stem having a first end and a second end, the stem positioned substantially perpendicular to the upper surface, the stem extending into the interior or the electronic appartus, the first end adjacent to the upper surface;

(d) an actuating switch positioned such that the stem actuates the actuating switch when the upper surface is depressed;

(e) at least one light source positioned within the interior of the electronic apparatus such that emissions from the light source is capable of extending through the translucent portion of the upper surface when the light sour is actuated;

(f) a spring having an interior axis and an interior diameter, positioned such that the stem is located along the interior axis, and disposed to maintain the upper surface in a relaxed position when the upper surface is undepressed; and (g) at least three ribs positioned along the stem to establish a stem diameter that is greater than the interior diameter of the spring when the spring is a relaxed position, each rib also including a locking rib sized and positioned to engage at least one loop of the spring such that the spring may remain attached to the stem during assembly of the electronic apparatus.

6. The electronic apparatus of claim 5, further comprising at least one light sensor positioned within the interior of the electronic apparatus such that the at least one light sensor detects light received through the translucent portion of the upper surface.

7. The electronic apparatus of claim 5, wherein the translucent portion comprises the entire upper surface.

8. An electronic apparatus, comprising:

(a) a housing and an interior;

(b) an upper surface positioned to form a portion of the exterior of the electronic apparatus;

(c) a stem having a first end and a second end, the stem positioned substantially perpendicular to the upper surface, the stem extending into the interior of the electronic apparatus, the first end adjacent to the upper surface;

(d) an actuating switch positioned such that the stem actuates the actuating switch when the upper surface is depressed;

(e) a spring having an interior axis and an interior diameter, positioned such that the stem is located along the interior axis, and disposed to maintain the upper surface in a relaxed position when the upper surface is undepressed; and (f) at least three ribs positioned along the stem to establish a stem diameter that is greater than the interior diameter of the spring when the spring is in a relaxed position, each of said at least three ribs also including a locking rib sized and positioned to engage at least one loop of the spring such that the spring may remain attached to the stem during assembly of the electronic apparatus.

9. A push button assembly comprising:

an upper surface position substantially along an exterior of a portable electronic apparatus, the electronic apparatus also having an interior, and the upper surface displaceable by a finger;

means for supporting a translucent portion on the upper surface positioned substantially along the exterior of the portable electronic apparatus;

means for biasing the upper surface in a relaxed position when the upper surface is in an undepressed position;

means for extending a stem into the interior of the electronic apparatus, the stem having a first end and a second end, the stem positioned substantially perpendicular to the upper surface, the first end adjacent to the upper surface, the stem having at least three ribs positioned along the stem, each rib also including a locking rib sized and positioned to engage a portion of the means for biasing such that the means for biasing may remain attached to the stem during assembly of the electronic apparatus;

switch means actuated when the upper surface is depressed;

at least one light source positioned within the interior of the electronic apparatus; and means for extending emissions from said at least one light source through the translucent portion of the upper surface when the light source is actuated.

10. The push button assembly of claim 9, further comprising:

means for sensing the light received through the translucent portion of the upper surface.

11. The push button assembly of claim 9, further comprising:

means for maintaining a separation between the actuating switch and the stem when the upper surface is in an undepressed position.

12. A method of making a push button assembly, comprising the steps of:

supporting a translucent portion on an upper surface positioned substantially along an exterior of a portable electronic apparatus, the electronic apparatus also having an interior, and the upper surface displaced by a finger;

extending a stem into the interior of the electronic apparatus, the stem having a first end and a second end, the stem positioned substantially perpendicular to the upper surface, the first end adjacent to the upper surface;

positioning a spring having an interior axis and an interior diameter, positioned such that the stem is located along the interior axis, and disposed to maintain the upper surface in a relaxed position when the upper surface is in an undepressed position;

positioned at least three ribs along the stem to establish a stem diameter that is greater than the interior diameter of the spring when the spring is in a relaxed position;

providing a locking rib on each rib which is sized and positioned to engage at least one loop of the spring such that the spring may remain attached to the stem during assembly of the electronic apparatus;

positioning an actuating switch such that the stem actuates the actuating switch when the upper surface is depressed; and extending at least one light source through the translucent portion of the upper surface when the light source is actuated, the light source being positioned within the interior of the electronic apparatus.

13. The method of claim 12, further comprising the step of:

sensing the light received through the translucent portion of the upper surface.

14. The method of claim 12, further comprising the step of:

maintaining a separation between the actuating switch and the stem when the upper surface is in an undepressed position.

* * * * *